United States Patent [19]

Carlos

[11] Patent Number: 4,532,060

[45] Date of Patent: Jul. 30, 1985

[54] HYDROCARBON OXIDATE COMPOSITION

[75] Inventor: Donald D. Carlos, Louisville, Ky.

[73] Assignee: Warner-Lambert Company, Morris Plains, N.J.

[21] Appl. No.: 544,655

[22] Filed: Oct. 24, 1983

[51] Int. Cl.[3] ..... C10M 5/12; C10M 1/20

[52] U.S. Cl. ..... 252/55; 252/56 R; 252/42.7

[58] Field of Search ..... 252/55, 56, 42.7

[56] References Cited

U.S. PATENT DOCUMENTS

| | | | |
|---|---|---|---|
| 2,424,588 | 7/1947 | Sparks et al. | 252/56 |
| 2,798,852 | 7/1957 | Wiese et al. | 252/42.7 |
| 4,186,077 | 1/1980 | Carlos | 208/3 |
| 4,198,285 | 4/1980 | Carlos | 208/3 |
| 4,388,244 | 6/1983 | Carlos | 252/51.5 A |

*Primary Examiner*—William R. Dixon, Jr.
*Assistant Examiner*—C. Johnson
*Attorney, Agent, or Firm*—Louis S. Gillow

[57] ABSTRACT

A hydrocarbon oxidate composition which comprises the reaction product of (a) a hydrocarbon oxidate, as described herein, or the metal salt thereof, with (b) a polyol as described herein, wherein the hydrocarbon oxidate composition comprises a wax oxidate and has a very high viscosity and increased molecular weight and is useful as a lubricant, grease, or protective coating.

56 Claims, No Drawings

HYDROCARBON OXIDATE COMPOSITION

FIELD OF THE INVENTION

This invention relates to a hydrocarbon oxidate composition having a very high viscosity and increased molecular weight, and to a method for producing the same. More specifically, this invention relates to a hydrocarbon oxidate composition which comprises the reaction product of (a) a hydrocarbon oxidate, as described herein, or the metal salt thereof, with (b) a polyol as described herein, wherein the hydrocarbon oxidate composition comprises wax oxidate.

BACKGROUND OF THE INVENTION

Oxidized petroleum fractions, which fractions include waxes and petrolatums, are known as a source of saponifiable material useful in the production of lubricating greases and in the formulation of protective coatings.

Highly oxidized petroleum fractions and processes for their production are described in U.S. Pat. Nos. 4,186,077 and 4,198,285. Oxidation of petroleum fractions, e.g., petrolatums, utilizing the processing conditions described in these two U.S. patents provides oxidates having high acid numbers which have advantageous properties over oxidates produced in accordance with previous oxidation techniques.

While oxidates produced conventionally and in accordance with the processes disclosed in the abovedescribed in U.S. patents have advantageous properties, the viscosity, molecular weight and integrity of these oxidate products are not completely sufficient for all applications and improvements in these and other desired characteristics of oxidate products are needed.

In U.S. Pat. No. 4,388,244 a polyamine is admixed with a petrolatum or hydrocarbon wax oxidate to improve various properties thereof related to their use as protective coatings. When coated, these formulations exhibit good film forming properties with significant corrosion and weathering resistance. However, low petrolatum content coatings do not provide adequate salt spray resistance. This is especially apparent with formulations containing 100% hydrocarbon wax oxidate, i.e., a minimal content of petrolatum oxidate. This disadvantage is important in view of the decreasing supply of petrolatum and quality control thereof.

In copending application Ser. No. 497,785, filed May 25, 1983, entitled Hydrocarbon Oxidate Composition, a polyamine and at least one copolymer of an olefin and a comonomer, selected from an unsaturated carboxylic acid or a vinyl ester of a saturated carboxylic acid, is admixed with a hydrocarbon oxidate to provide a composition having high viscosity, increased molecular weight and superior weathering resistance, i.e., salt spray resistance when used as a protective coating. However, this composition requires the use of a polyamine which may not be desirable for all applications.

SUMMARY OF THE INVENTION

Accordingly, an object of this invention is to provide a hydrocarbon oxidate composition having high viscosity and increased molecular weight.

A further object of this invention is to provide a process for producing said high-viscosity hydrocarbon oxidate composition.

An even further object of this invention is to provide a process for increasing the molecular weight and viscosity of a hydrocarbon oxidate.

A still further object of this invention is to provide compositions containing the high-viscosity hydrocarbon oxidate composition, which are useful as lubricants, greases, corrosion inhibitor compositions, protective coating compositions and the like.

These and other objects are achieved by the invention described herein.

In one embodiment, the present invention provides a hydrocarbon oxidate composition which comprises the reaction product of (a) a hydrocarbon oxidate composition comprising a wax oxidate, with (b) a polyol capable of increasing the viscosity of the reaction product when conducting the reaction at at least 100° F.; or the metal salt of such reaction product.

In a further embodiment, the present invention provides a method of producing a high-viscosity hydrocarbon oxidate composition comprising reacting (a) a hydrocarbon oxidate composition comprising a wax oxidate, with (b) a polyol capable of increasing the viscosity of the reaction product when conducting the reaction at at least 100° F., and (c) a metal salt forming compound; to produce the reaction product or the metal salt thereof described above.

DETAILED DESCRIPTION OF THE INVENTION

In this invention, the starting material used is a hydrocarbon oxidate comprising a wax oxidate, or a metal salt thereof. Such a hydrocarbon oxidate comprises the oxidation product having a high acid number obtained on oxidizing a hydrocarbon wax.

Exemplary hydrocarbon starting materials and techniques for producing, by oxidation, the hydrocarbon oxidate used in this invention are described in U.S. Pat. Nos. 4,186,077 and 4,198,285, the disclosure of which is incorporated herein by reference.

Particularly, suitable hydrocarbon wax feed stocks which can be used and oxidized to obtain the hydrocarbon wax oxidate suitable for use in this invention are hydrocarbons comprising a mixture of straight and branched chain saturated hydrocarbons having on the average 20 to 50 carbon atoms per molecule and an oil content of 10 to 30% by weight, preferably 12 to 22% by weight. In particular, preferred hydrocarbon waxes which can be oxidized to produce a particularly useful starting material are hydrocarbon waxes containing about 20 to about 44 carbon atoms. Useful hydrocarbon oxidates may also be produced by oxidation of mixtures thereof.

Suitable hydrocarbon oxidates which can be used in this invention can be appropriately prepared by oxidizing these hydrocarbon feed stocks as described above using processes known in the art. Such a hydrocarbon oxidate will be suitable for use herein if the oxidate has an acid number of about 35 to about 120, preferably 70 to about 120 for a hydrocarbon wax oxidate. As used herein, the term "acid number" is defined to mean the number of milligrams of potassium hydroxide required to neutralize 1 gram of sample.

As set forth above, a hydrocarbon wax oxidate, or a metal salt thereof, can be used as a starting material in this invention. For simplicity in the disclosure to be given hereinafter, the term "oxidate" will be employed throughout and such term is intended to include not only the hydrocarbon oxidate *per se,* but also to include the metal salts thereof.

As described above, the hydrocarbon wax is simply oxidized using conventional known techniques, for example, using conventional redox catalysts such as manganese salts. Further, the technique disclosed in U.S. Pat. No. 4,186,077, wherein an oxidate is obtained by blowing an oxidizing gas through a liquid mass of the hydrocarbon in the presence of an amine oxide under the conditions as described therein, can be used. Alternatively, an oxidate appropriate for use in this invention can be obtained by oxidizing a hydrocarbon in accordance with the procedure described in U.S. Pat. No. 4,198,285 by blowing an oxidizing gas through a liquid mass of the hydrocarbon in the presence of a sulfobetaine.

To produce the high viscosity oxidate composition of this invention, it is only necessary to react the oxidate with a polyol.

The polyol employed in the present invention is preferably a 1,2-diol or 1,3-diol but may be other polyols such as 1,2,3-triols etc. Examples of such 1,2-diols include ethylene glycol and propylene glycol, while examples of such 1,3-diols include trimethylolpropane. Examples of other polyols useful in the present invention include glycerol, d-sorbitol and 9,10-dihydroxy stearic acid.

The reaction of the oxidate with the polyol can be conducted at a temperature of about 100° F. to about 350° F. (about 37.8° C. to about 176.5° C.), more generally, 200° F. to 250° F. (93° C. to 121° C.) under atmospheric pressure. Subatmospheric pressure or superatmospheric pressure can also be used, if desired.

The time of reaction for the polyol with the oxidate is not critical and will vary depending on the reactants and the temperature employed. In general, an appropriate time of reaction can be determined by measuring the viscosity characteristics of the produced high viscosity oxidate composition. In general, high-viscosity oxidate compositions of this invention have a viscosity of about 10,000 to about 100,000 cps, more preferably about 30,000 to 80,000 cps, at about 25° C.

The oxidate composition of this invention is considered to have a high viscosity, i.e., a viscosity of about 10,000 to about 100,000 CPS at about 25° C., which is markedly higher than the viscosity range generally encountered in prior art hydrocarbon oxidates of about 10 to about 200 CPS at about 25° C. and for the calcium salts thereof of about 200 to about 8000 CPS at about 25° C. Further, the viscosity of the oxidate composition of this invention can be adjusted by addition thereto of appropriate additives such as compatible solvents (e.g., mineral spirits) or by the addition of small amounts (less than 1.0%) of water, if desired.

As indicated above, in one embodiment of this invention, by reacting the oxidate with a polyol, the characteristics possessed by the oxidate prior to the reaction with a polyol are altered. For example, the viscosity of the oxidate used as a starting material is less than that of the oxidate reaction product. In addition, increased clarity and consistency are obtained with the compositions of this invention.

In the reaction between the polyol and the oxidate, the polyol should be added in an amount of from 0.005 to 0.25 equivalents, preferably about 0.01 to 0.2 equivalents based on the number of hydroxyl groups.

As indicated above, the oxidate of this invention can comprise the reaction product of a hydrocarbon oxidate with a polyol or the metal salt of the reaction product of the oxidate with the polyol. Where metal salts (sometimes designated a "soap") are desired, any basic metal salt can be used. Suitable metal salts include those of lithium, sodium, potassium, magnesium, rubidium, strontium, cesium, barium, cadmium, aluminum, tin, bismuth, zinc and mixtures thereof. Preferred salts are zinc and calcium salts and appropriate basic calcium and zinc salts such as calcium hydroxide, calcium oxide, zinc oxide and the like can be used.

A suitable amount of the compound for forming the salt of the oxidation product can range from 90% to 150% equivalency, preferably 100–125% equivalency, based on the acid number of the oxidate reaction product.

Where the metal salt oxidate reaction product is desired, the oxidate as a starting material can be reacted with the metal salt forming compound and then with the polyol as described above or the reaction product of the oxidate and the polyol can be produced and then reacted with the basic salt described above in order to form the metal salt of the oxidate composition. Appropriate reaction procedures for the formulation of the oxidate reaction product in the metal salt form can be by simply mixing, in any order, the reactants, with stirring, at about room temperature to about 400° F. (204.5° C.), more generally at about 150° to about 220° F. (75.5° to 104.5° C.).

Alternatively, where the metal salt oxidate reactant product is desired, the metal salt forming compound, the oxidate starting material and the polyol can all be combined and reacted simultaneously to obtain the salt of the oxidate reaction product. Where a simultaneous reaction is accomplished, appropriate parameters can be selected from those given above.

More specifically, the metal salt oxidate, i.e., soap, of the present invention can be prepared by combining (1) a compatible solvent in an amount of from 30 to 60% by weight, preferably 40 to 50% by weight; (2) polyol to be used in an amount of from 0.005 to 0.25 equivalents, preferably 0.01 to 0.2 equivalents; and (3) lime in an amount of from 1 to 5% by weight, preferably 2 to 3.5% by weight, with the higher concentration of lime being used with higher acid number oxidates, in a container of appropriate size. The addition of ingredients (1)–(3) can be carried out in any order. At approximately 100° to 170° F., molten hydrocarbon oxidate in an amount of from 35 to 55% by weight, preferably 40 to 45% by weight, is added to the container with stirring. The temperature is then raised to about 200° to 250° F., preferably 210° to 225° F., and the mixture is allowed to react until the desired viscosity is reached, generally 0.5 to 24 hours; with small batches, 0.5 to 4 hours, preferably 0.75 to 2 hours.

Conventional additives such as thinners, organic clays, pigments and the like, for known purposes and in conventional amounts, can also be added to the compositions of this invention to produce a broad range of different types of useful products.

The reaction product of the oxidate with the polyol of this invention can be advantageously employed to produce greases, lubricants, corrosion inhibitor compositions, protective coatings, etc. Accordingly, the use of such as a grease or lubricant for machinery, automobiles, aircraft, marine craft, etc., as a protective coating for such or as a corrosion resistant composition to protect any type of metal surface from, e.g., oxidation, or other alteration, is particularly advantageous. That is, the oxidate composition of this invention is useful in protecting metal surfaces from the effects of salt spray, humidity, and like external conditions. Without such protection, deleterious effects on the metal surfaces arise.

The following examples are given to illustrate the present invention in greater detail. These examples are to be construed as merely exemplary and non-limiting. Unless otherwise indicated, all parts, percents, ratios, and the like are by weight.

COMPARATIVE EXAMPLE A

A hydrocarbon wax oxidate with an acid number of 91.0 and an oil content of 18% by weight, produced by conventionally oxidizing a hydrocarbon wax starting material, was used.

Mineral spirits (226.0 grams) was placed in a 1 liter beaker and 14.1 grams of lime (0.381 equivalents), in powder form, was dusted into the mineral spirits with continuous mixing to form a lime slurry. Heating was then initiated along with stirring of the slurry. At approximately 150° F., molten (150° to 200° F.) hydrocarbon wax oxidate (235.0 g, 0.381 equivalents) was added to the beaker slowly with the continuous stirring. The temperature was then raised to 200°-220° F. and the mixture was allowed to react with stirring. After ½ hour of reaction, stirring was discontinued and the product was allowed to cool to room temperature and equilibrate overnight. The resultant product was 100% hydrocarbon wax oxidate soap.

COMPARATIVE EXAMPLE B 200.0 grams of the 100% hydrocarbon wax oxidate soap of Comparative Example A was heated to about 200° F. and maintained at a temperature of about 200°-220° F. for ½ hour. The resultant product was cooled to 150° F. with stirring and then bottled for later viscosity measurements.

EXAMPLE 1

200.0 grams of the 100% hydrocarbon wax oxidate soap of Comparative Example A was heated to about 200° F. and 14.5 g (0.472 equivalents) of glycerol was added thereto with continuous stirring. The mixture was maintained at a temperature of about 200°-220° F. for ½ hour. The resultant product was cooled to 150° F. with stirring and then bottled for later viscosity measurements.

EXAMPLE 2

200.0 grams of the 100% hydrocarbon wax oxidate soap of Comparative Example A was heated to about 200° F. and 4.8 g (0.157 equivalents) of glycerol was added thereto with continuous stirring. The mixture was maintained at a temperature of about 200°-220° F. for ½ hour. The resultant product was cooled to 150° F. with stirring and then bottled for later viscosity measurements.

EXAMPLE 3

200.0 grams of the 100% hydrocarbon wax oxidate soap of Comparative Example A was maintained at room temperature and 0.48 g (0.0157 equivalents) of glycerol was added thereto with stirring. The resultant product was then bottled for later viscosity measurements.

EXAMPLE 4

200.0 grams of the 100% hydrocarbon wax oxidate soap of Comparaive Example A was heated to about 200° F. and 0.48 g (0.0157 equivalents) of glycerol was added thereto with continuous stirring. The mixture was maintained at a temperature of about 200°-220° F. for ½ hour. The resultant product was cooled to 150° F. with stirring and then bottled for later viscosity measurements.

EXAMPLE 5

200.0 grams of the 100% hydrocarbon wax oxidate soap of Comparative Example A was maintained at room temperature and 0.49 g (0.0157 equivalents) of ethylene glycol was added thereto with stirring. The resulting product was then bottled for later viscosity measurements.

EXAMPLE 6

200.0 grams of the 100% hydrocarbon wax oxidate soap of Comparative Example A was heated to about 200° F. and 0.49 g (0.0157 equivalents) of ethylene glycol was added thereto with continuous stirring. The mixture was maintained at a temperature of about 200°-220° F. for ½ hour. The resultant product was cooled to 150° F. with stirring and then bottled for later viscosity measurements.

COMPARATIVE EXAMPLE C 200.0 grams of the 100% hydrocarbon wax oxidate soap of Comparative Example A was heated to about 200° F. and 0.83 g (0.0157 equivalents) of diethylene glycol was added thereto with continuous stirring. The mixture was maintained at a temperature of about 200°-220° F. for ½ hour. The resultant product was cooled to 150° F. with stirring and then bottled for later viscosity measurements.

COMPARATIVE EXAMPLE D 200.0 grams of the 100% hydrocarbon wax oxidate soap of Comparative Example A was heated to about 200° F. and 1.18 g (0.0157 equivalents) of triethylene glycol was added thereto with continuous stirring. The mixture was maintained at a temperature of about 200°-220° F. for ½ hour. The resultant product was cooled to 150° F. with stirring and then bottled for later viscosity measurements.

EXAMPLE 7

200.0 grams of the 100% hydrocarbon wax oxidate soap of Comparative Example A was heated to about 200° F. and 0.7 g (0.0157 equivalents) of trimethylolpropane was added thereto with continuous stirring. The mixture was maintained at a temperature of about 200°-220° F. for ½ hour. The resultant product was cooled to 150° F. with stirring and then bottled for later viscosity measurements.

EXAMPLE 8

200.0 grams of the 100% hydrocarbon wax oxidate soap of Comparative Example A was heated to about 200° F. and 0.5 g (0.0157 equivalents) of d-sorbitol was added thereto with continuous stirring. The mixture was maintained at a temperature of about 200°-220° F. for ½ hour. The resultant product was cooled to 150° F. with stirring and then bottled for later viscosity measurements.

EXAMPLE 9

200.0 grams of the 100% hydrocarbon wax oxidate soap of Comparative Example A was heated to about 200° F. and 2.49 g (0.0157 equivalents) of 9,10-dihydroxy stearic acid was added thereto with continuous stirring. The mixture was maintained at a temperature of about 200°-220° F. for ½ hour. The resultant product was cooled to 150° F. with stirring and then bottled for later viscosity measurements.

COMPARATIVE EXAMPLE E 200.0 grams of the 100% hydrocarbon wax oxidate soap of Comparative Example A was heated to about 200° F. and 0.93 g (0.0157 equivalents) of 1,6-hexanediol was added thereto with continuous stirring. The mixture was maintained at a temperature of about 200°-220° F. for ½ hour. The resulant product was cooled to 150° F. with stirring and then bottled for later viscosity measurements.

COMPARATIVE EXAMPLE F 200.0 grams of the 100% hydrocarbon wax oxidate soap of Comparative Example A was heated to about 200° F. and 0.71 g (0.0157 equivalents) of 1,4-butanediol was added thereto with continuous stirring. The mixture was maintained at a temperature of about 200°-220° F. for ½ hour. The resultant product was cooled to 150° F. with stirring and then bottled for later viscosity measurements.

COMPARATIVE EXAMPLE G 200.0 grams of the 100% hydrocarbon wax oxidate soap of Comparative Example A was heated to about 200° F. and 0.71 g (0.0157 equivalents) of 1,3-butanediol was added thereto with continuous stirring. The mixture was maintained at a temperature of about 200°-220° F. for ½ hour. The resultant product was cooled to 150° F. with stirring and then bottled for later viscosity measurements.

Viscosities were measured conventionally with a Brookfield Model RVT viscometer with the appropriate spindle employed based on the estimated viscosity range of the final reaction product. The viscosity results are shown in the following Table.

The results in the following Table demonstrate that the use of polyols as in the present invention greatly increases the viscosity of the resulting hydrocarbon wax oxidate reaction product.

As shown in the Table below, not all 1,3-diols, i.e., Comparative Example G, are effective in the present invention. However, ordinary experimentation can be conducted to determine suitable 1,3-diols which would be useful in the present invention.

TABLE

| Example | Additive | Equivalents of Additive | Reaction Temperature | Brookfield Vis. 2 RPM | Brookfield Vis. 20 RPM |
|---|---|---|---|---|---|
| Comparative A | none | none | Room Temp. | 800 | 800 |
| Comparative B | none | none | 200-220° F. | 5,600 | 5,200 |
| 1 | glycerol | 0.472 | 200-220° F. | 3,000 | 3,000 |
| 2 | glycerol | 0.157 | 200-220° F. | 44,000 | 43,000 |
| 3 | glycerol | 0.0157 | Room Temp. | 800 | 600 |
| 4 | glycerol | 0.0157 | 200-220° F. | 50,000 | 46,000 |
| 5 | ethylene glycol | 0.0157 | Room Temp. | 1,400 | 1,400 |
| 6 | ethylene glycol | 0.0157 | 200-220° F. | 80,000 | 52,000 |
| Comparative C | diethylene glycol | 0.0157 | 200-220° F. | 1,200 | 1,000 |
| Comparative D | triethylene glycol | 0.0157 | 200-220° F. | 1,200 | 1,200 |
| 7 | trimethylolpropane | 0.0157 | 200-220° F. | 30,000 | 29,000 |
| 8 | d-sorbitol | 0.0157 | 200-220° F. | 30,000 | 20,000 |
| 9 | 9,10-dihydroxy stearic acid | 0.0157 | 200-220° F. | 16,600 | 16,400 |
| Comparative E | 1,6-hexanediol | 0.0157 | 200-220° F. | 3,100 | 3,000 |
| Comparative F | 1,4-butanediol | 0.0157 | 200-220° F. | 3,400 | 3,400 |
| Comparative G | 1,3-butanediol | 0.0157 | 200-220° F. | 1,200 | 1,000 |

While the invention has been described in detail and with respect to specific embodiments thereof, it will be apparent that changes and modifications can be made therein without departing from the spirit and scope thereof.

I claim:

1. A hydrocarbon wax oxidate composition having high viscosity comprising the reaction product:

(a) a hydrocarbon wax oxidate having from 20 to 50 carbon atoms per molecule and an acid number ranging from about 35 to about 120, with (b) a polyol capable of increasing the viscosity of the resulting product to at least 10,000 cps at about 25° C. when conducting the reaction at least 100° F., or the metal salt of said reaction product.

2. The composition of claim 1, wherein said hydrocarbon wax oxidate composition is the reaction product of (a) and (b).

3. The composition of claim 1, wherein said hydrocarbon wax oxidate composition is the metal salt of the reaction product of (a) and (b).

4. The composition of claim 1, wherein said polyol is a 1,2- or 1,3-diol.

5. The composition of claim 4, wherein said 1,2-diol is selected from the group consisting of ethylene glycol and propylene glycol.

6. The composition of claim 4, wherein said 1,3-diol is trimethylolpropane.

7. The composition of claim 1, wherein said polyol is selected from the group consisting of glycerol, d-sorbitol and 9,10-dihydroxy stearic acid.

8. The composition of claim 1, wherein said polyol is used in an amount of from 0.005 to 0.25 equivalents based on the number of hydroxyl groups.

9. The composition of claim 1, wherein said polyol is used in an amount of from 0.01 to 0.2 equivalents based on the number of hydroxy groups.

10. The composition of claim 1, wherein the reaction is conducted at about 100° F. to 350° F.

11. The composition of claim 1, wherein the reaction is conducted at about 200° F. to 250° F.

12. The composition of claim 1, wherein said composition has a viscosity ranging from about 10,000 to about 100,000 cps at about 25° C.

13. The composition of claim 1, wherein said composition has a viscosity ranging from about 30,000 to about 80,000 cps at about 25° C.

14. The composition of claim 1, wherein said metal salt is a salt of lithium, sodium, potassium, magnesium, rubidium, strontium, cesium, barium, cadmium, aluminum, tin, bismuth or zinc.

15. The composition of claim 1, wherein said salt is the calcium salt or the zinc salt.

16. The composition of claim 1, wherein said salt is the calcium salt.

17. A method for altering the characteristics of hydrocarbon wax oxidates or the metal salts thereof comprising forming the reaction product of:

(a) a hydrocarbon wax oxidate having from 20 to 50 carbon atoms per molecule and an acid number ranging from about 35 to about 120, with (b) a polyol capable of increasing the viscosity of the resulting product to at least 10,000 cps at about 25° C. when conducting the reaction at least at 100° F., or a metal salt of said reaction product.

18. The method of claim 17, wherein said polyol is a 1,2- or 1,3-diol.

19. The method of claim 18, wherein said 1,2-diol is selected from the group consisting of ethylene glycol and propylene glycol.

20. The method of claim 18, wherein said 1,3-diol is trimethylolpropane.

21. The method of claim 17, wherein said polyol is selected from the group consisting of glycerol, d-sorbitol and 9,10-dihydroxy stearic acid.

22. The method of claim 17, wherein said polyol is used in an amount of from 0.005 to 0.25 equivalents based on the number of hydroxyl groups.

23. The method of claim 17, wherein said polyol is used in an amount of from 0.01 to 0.2 equivalents based on the number of hydroxyl groups.

24. The method of claim 17, wherein the reaction is conducted at about 100° F. to 350° F.

25. The method of claim 17, wherein the reaction is conducted at about 200° F. to 250° F.

26. The method of claim 17, wherein said composition has a viscosity ranging from about 10,000 to about 100,000 cps at about 25° C.

27. The method of claim 17, wherein said composition has a viscosity ranging from about 30,000 to about 80,000 cps at about 25° C.

28. The method of claim 17, wherein said metal salt is a salt of lithium, sodium, potassium, magnesium, rubidium, strontium, cesium, barium, cadmium, aluminum, tin, bismuth or zinc.

29. A method of producing a hydrocarbon wax oxidate composition comprising reacting:

(a) a hydrocarbon wax oxidate having from 20 to 50 carbon atoms per molecule and an acid number ranging from about 35 to about 120, with (b) a polyol capable of increasing the viscosity of the resulting product to at least 10,000 cps at about 25° C. when conducting the reaction at least at 100° F.

30. A method of producing a metal salt of a hydrocarbon wax oxidate composition comprising reacting:

(a) a hydrocarbon wax oxidate having from 20 to 50 carbon atoms per molecule and an acid number ranging from about 35 to about 120, with (b) a polyol capable of increasing the viscosity of the resulting product to at least 10,000 cps at about 25° C. when conducting the reaction at least at 100° F., and (c) a metal salt forming compound.

31. The method of claim 29, wherein said metal salt is a salt of lithium, sodium, potassium, magnesium, rubidium, strontium, cesium, barium, cadmium, aluminum, tin, bismuth or zinc.

32. The method of claim 30, wherein said metal salt is a salt of lithium, sodium, potassium, magnesium, rubidium, strontium, cesium, barium, cadmium, aluminum, tin, bismuth or zinc.

33. The method of claim 29, wherein said salt is the calcium salt or the zinc salt.

34. The method of claim 30, wherein said salt is the calcium salt or the zinc salt.

35. The method of claim 29, wherein said salt is the calcium salt.

36. The method of claim 30, wherein said salt is the calcium salt.

37. The method of claim 29, wherein said polyol is a 1,2- or 1,3-diol.

38. The method of claim 30, wherein said polyol is a 1,2- or 1,3-diol.

39. The method of claim 37, wherein said 1,2-diol is selected from the group consisting of ethylene glycol and propylene glycol.

40. The method of claim 38, wherein said 1,2-diol is selected from the group consisting of ethylene glycol and propylene glycol.

41. The method of claim 37, wherein said 1,3-diol is trimethylolpropane.

42. The method of claim 38, wherein said 1,3-diol is trimethylolpropane.

43. The method of claim 29, wherein said polyol is selected from the group consisting of glycerol, d-sorbitol and 9,10-dihydroxy stearic acid.

44. The method of claim 30, wherein said polyol is selected from the group consisting of glycerol, d-sorbitol and 9,10-dihydroxy stearic acid.

45. The method of claim 29, wherein said polyol is used in an amount of from 0.005 to 0.25 based on the number of hydroxyl groups.

46. The method of claim 30, wherein said polyol is used in an amount of from 0.005 to 0.25 based on the number of hydroxyl groups.

47. The method of claim 29, wherein said polyol is used in an amount of from 0.01 to 0.2 equivalents based on the number of hydroxyl groups.

48. The method of claim 30, wherein said polyol is used in an amount of from 0.01 to 0.2 equivalents based on the number of hydroxyl groups.

49. The method of claim 29, wherein the reaction is conducted at about 100° F. to 350° F.

50. The method of claim 30, wherein the reaction is conducted at about 100° F. to 350° F.

51. The method of claim 29, wherein the reaction is conducted at about 200° F. to 250° F.

52. The method of claim 30, wherein the reaction is conducted at about 200° F. to 250° F.

53. The method of claim 29, wherein said composition has a viscosity ranging from about 10,000 to about 100,000 cps at about 25° C.

54. The method of claim 30, wherein said composition has a viscosity ranging from about 10,000 to about 100,000 cps at about 25° C.

55. The method of claim 29, wherein said composition has a viscosity ranging from 30,000 to about 80,000 cps at about 25° C.

56. The method of claim 30, wherein said composition has a viscosity ranging from about 30,000 to about 80,000 cps at about 25° C.

* * * * *

UNITED STATES PATENT AND TRADEMARK OFFICE

CERTIFICATE OF CORRECTION

PATENT NO. : 4,532,060

DATED : July 30, 1985

INVENTOR(S) : Donald D. Carlos

It is certified that error appears in the above—identified patent and that said Letters Patent is hereby corrected as shown below:

Page 1, Assignor to Warner-Lambert Company, Morris Plains, NJ should be corrected to --Assignor to Ashland Oil, Inc., Ashland KY--.

Signed and Sealed this

*Twenty-sixth* Day of *August 1986*

[SEAL]

*Attest:*

DONALD J. QUIGG

*Attesting Officer*

*Commissioner of Patents and Trademarks*